US005101365A

United States Patent [19]

Westberg et al.

[11] Patent Number: 5,101,365

[45] Date of Patent: * Mar. 31, 1992

[54] APPARATUS FOR EXTENDING WINDOWS USING Z BUFFER MEMORY

[75] Inventors: Thomas Westberg, Mountain View; Serdar Ergene, San Jose; Szu-Cheng Sun, Santa Clara, all of Calif.

[73] Assignee: Sun Microsystems, Inc., Mountain View, Calif.

[ * ] Notice: The portion of the term of this patent subsequent to Mar. 6, 2007 has been disclaimed.

[21] Appl. No.: 610,268

[22] Filed: Nov. 7, 1990

Related U.S. Application Data

[63] Continuation of Ser. No. 265,240, Oct. 31, 1988, abandoned.

[51] Int. Cl.[5] ..... G06F 3/14; G06F 15/62; G09G 1/16

[52] U.S. Cl. ..... 395/158; 340/721; 340/799; 340/750; 395/122; 395/165

[58] Field of Search ..... 364/521, 522, 518; 340/721, 723, 729, 799, 750

[56] References Cited

U.S. PATENT DOCUMENTS

| | | | |
|---|---|---|---|
| 4,475,104 | 10/1984 | Shen | 340/729 |
| 4,598,384 | 7/1986 | Shaw et al. | 364/900 |
| 4,609,917 | 9/1986 | Shen | 340/729 |
| 4,736,309 | 4/1988 | Johnson et al. | 364/521 |
| 4,769,762 | 9/1988 | Tsujido | 364/521 |
| 4,819,189 | 4/1989 | Kikuchi et al. | 364/521 |
| 4,907,174 | 3/1990 | Priem | 364/521 |

OTHER PUBLICATIONS

Guttag et al., "Video Display Processor Simulates Three Dimensions", Electronics, 20 Nov. 1980, pp. 123-125.

*Primary Examiner*—Gary V. Harkcom
*Assistant Examiner*—Raymond J. Bayerl
*Attorney, Agent, or Firm*—Blakely Sokoloff Taylor & Zafman

[57] ABSTRACT

A computer system which has a display memory for storing information to be presented on an output display, and a full screen bitmapped window identification memory for storing information regarding window position on an output display, and uses circuitry for comparing incoming information with information stored in the window identification memory to determine whether the incoming information should appear in a particular window of the output display, and also includes a second full screen bitmapped memory normally utilized for storing information indicative of other than window position on an output display and utilizes circuitry for selectively storing information in the second memory regarding window position on the output display when additional windows are required.

17 Claims, 4 Drawing Sheets

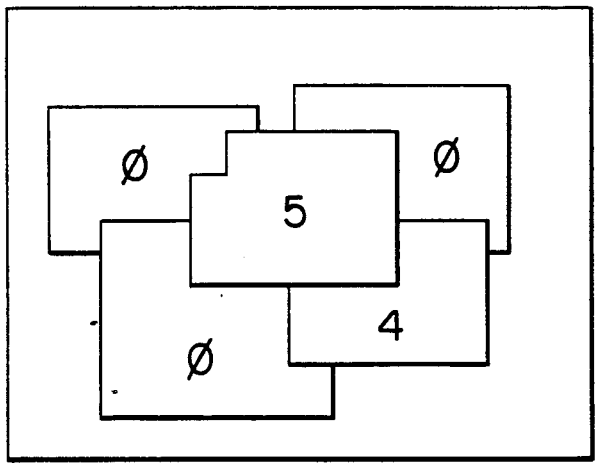
FIG. 3
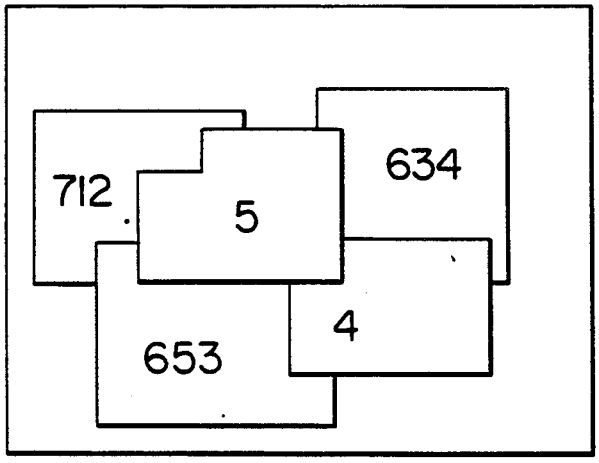
FIG. 4
| WID EXT ON | WID COMP = | WID EXT COMP. = | Z BUFFER <= | Z BUFF. & DISPLAY WRITE |
|---|---|---|---|---|
| 0 | 0 | X | X | 0 |
| 0 | 1 | X | 0 | 0 |
| 0 | 1 | X | 1 | 1 |
| 1 | X | 0 | X | 0 |
| 1 | X | 1 | 0 | 0 |
| 1 | X | 1 | 1 | 1 |
FIG. 5

| WID EXT | Z |
|---|---|
| Ø | 24 |
| 8 | 16 |
| 16 | 8 |
| 24 | Ø |

FIG. 6

APPARATUS FOR EXTENDING WINDOWS USING Z BUFFER MEMORY

This is a continuation of application Ser. No. 07/265,240 filed 10/31/88, and now abandoned.

This invention relates to logic circuitry and, more particularly, to logic circuitry which may be utilized to increase the number of windows which may be displayed by a computer system.

HISTORY OF THE PRIOR ART

One common interface used for computer operation utilizes multiple "windows" displayed on a cathode-ray tube to represent individual computer applications. In a system using windows, more than one program at a time is placed in a portion of memory available for instant call. The text and graphics output of each such program is made to appear in a window, a particular set of defined boundaries on the screen. Usually, the computer operator is operating a single one of these programs but may switch (often by a single keystroke) to another program in another window to work with that program, to call data from that program, to place data in that program, or for any number of other reasons. Each window may overlap other windows with the "front window" constituting the current active work file. The user may add or delete information from the current window, add new items to the window, refile the window in another location, and, generally, perform any other operations on the program in the window as he might were there no other windows.

Windowing systems have been found to be quite useful for advanced computer operations. For example, a skilled computer operator finds windowing systems to be quite useful for providing rapid shifting between different programs and documents. In a system which does not use windowing, the operator usually has to close one program before he may call up a new program in order to work with the new program. This takes a substantial amount of time. Moreover, a primary reason for switching between programs is to transfer data and graphic images between programs. A system which does not utilize windowing does not usually allow the easy transfer of information between programs.

It was, among other things, to make the operation of computers more rapid and to facilitate the transfer of data between documents and programs that windowing systems were devised.

For complicated tasks, it is often desirable to have running at the same time any number of windows, each with its different individual program or document, just as one might have many individual documents on one's desk for use in completing a particular task. However, most windowing systems are incapable of providing more than a limited number of windows which may be accessed at one time. For example, a system disclosed in copending patent application Ser. No. 07/254,957, entitled "Apparatus for Rapidly Clearing the Output Display of a Computer System", William Joy, et al., filed Oct. 31, 1988, U.S. Pat. No. 5,043,923, and assigned to the Assignee of the present invention has circuitry which allows a total of sixteen windows to be utilized at a time. Consequently, such systems still require, although to a lesser degree, that the operator switch between programs by closing one program before opening another where more than sixteen programs or documents are involved.

It is, therefore, an object of the present invention to provide a computer system which includes logic circuitry defining a windowing system which allows the selection of an essentially unlimited number of windows.

It is another object of this invention to provide a computer system capable of handling a large number of programs or documents at one time.

An additional object of the present invention is to provide logic circuitry for a computer system which may be selectively utilized for increasing the number of windows available at one time.

SUMMARY OF THE INVENTION

These and other objects of the invention are accomplished in a computer system which includes a display memory for storing information to be presented on an output display, a window identification memory for storing information regarding window position on an output display, a window identification register for storing window identification numbers indicative of the window in which a particular piece of data is to appear, a window identification comparator for determining if a number in the window identification register is equal to a window identification number at a particular pixel in the window identification register, a Z buffer memory for storing information indicative of the depth of information to appear on an output display, a Z buffer register for storing information indicative of the depth of each piece of information, a Z buffer comparator for determining whether the informative in the Z buffer register is at a depth equal to or less than the depth of the information stored in the Z buffer memory, a window extension register for storing a window number greater than is capable of storage in the window identification register, a control register for causing the storage of window identification numbers in the Z buffer memory, a window extension comparator for comparing numbers stored in the window extension register with numbers stored in the Z buffer memory, and write enable circuitry responsive to the window identification comparator, the Z buffer comparator, and the window extension comparator for causing information to be written to the window identification memory, the Z buffer memory, and the display memory.

These and other features and advantages of the present invention will become apparent to those skilled in the art upon reading the following detailed description in conjunction with the several figures of the drawing.

IN THE DRAWINGS

FIG. 3 is a pictorial illustration of the areas mapped out by storage of window numbers in the window identification memory where a window extension system is utilized in accordance with the present invention.

FIG. 4 is a pictorial illustration of the areas mapped out by storage of window numbers in the Z buffer memory where a window extension system is utilized in accordance with the present invention.

FIG. 5 is a truth table which may be utilized in understanding the operation of the circuitry of FIG. 2.

FIG. 6 is a diagram illustrating the bit size of the windows and depth indications which may be stored together in the Z buffer memory in one specific embodiment of the invention.

DETAILED DESCRIPTION OF THE INVENTION

Figure 1:
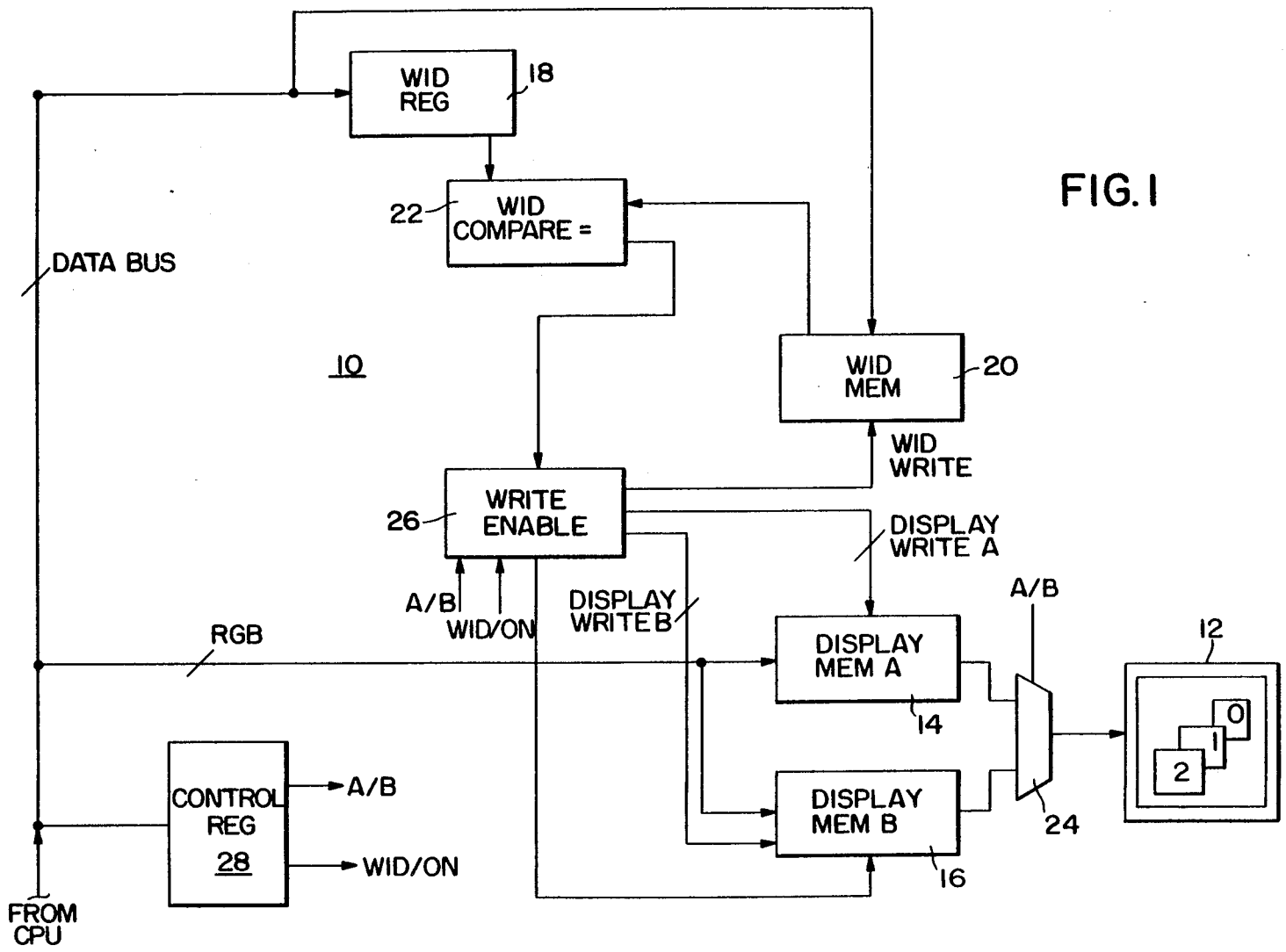
FIG. 1 is a block diagram illustrative of an arrangement for providing a plurality of windows disclosed in a copending patent application.

Referring now to FIG. 1 there is shown a windowing system for use in a computer system such as that illustrated in the copending patent application referred to above assigned to the assignee of the present patent application. FIG. 1 illustrates a window identification output system 10 which is utilized to provide output signals to a cathode ray tube (CRT) 12 which displays the different windows.

To produce an output on a computer output display, the screen full of images or text is represented in a block of memory known as a "bitmap". In its simplest form, each picture element (pixel) on the screen must be represented by a memory bit. For example, if the display screen has 1024 by 1024 pixels, then slightly more than one million bits of memory are necessary to represent each screen. In order to produce a color output, it is usual to have a number of bits of memory for each pixel of the display memory. In a preferred embodiment, each display memory may include twenty-four bits of storage for storing color information at each pixel. This is referred to as a 24 bit RGB color value. To store these 24 bit RGB color values, the system 10 includes a pair of double-buffered display memories 14 and 16, each of which includes a full bitmapped memory and are referred to as memories A and B. The system 10 also includes a window identification (WID) register 18 which in a preferred embodiment stores for bits of information and a window identification (WID) memory 20 which in the preferred embodiment comprises a full screen bitmapped memory which also stores four bits of information for each pixel.

A window identification (WID) comparator 22 receives output signals from the WID register 18 and the WID memory 20. The system 10 also includes a multiplexor 24, the cathode ray tube 12, write enable logic 26 for selectively enabling the writing of information to each of the display memories A and B and the window identification memory 20, and a control register 28 for controlling the operation of the system 10.

In operation, windows are first selected by values provided from a central processing unit (CPU). These values include both a pixel address and a window identification number for each pixel to be included within the window. The window identification number is written to each corresponding pixel lying within the boundaries of the particular window in the window identification memory. When a first window is written to the window identification memory, each memory position within that window carries the window identification number for that window. When a next window which lies in front of the first window is written to the window identification memory, the portions of the second window which overlay the first are written on top of the overlapped memory position of the first and, therefore, automatically cover and clip the first. After all of the windows desired have been stored in the window identification memory, the window identification memory has stored indications as shown in the display of the CRT in FIG. 1. For example, the first window to be defined in the window identification memory is shown as window 0 on the CRT, the second window (which overlays the first) as window 1, and the third window (which is in the foreground) as window 2.

When it is desired to write information to the display memory for particular windows, the information is written into the selected display memory A or B from the CPU through the data bus. The information includes a pixel address, an RGB color value as discussed above, and a window identification number. The window identification number is stored in the window identification register 18 and compared to the window identification number previously stored for that pixel in the window identification memory 20. If the window identification number stored in the window identification memory 20 is the same as that in the window identification register 18, the comparator circuit 22 causes the write enable logic 26 to allow the RGB information to be written to the addressed pixel of the selected display memory A or B. If the comparator circuitry 22 determines that the window identification number is not the same as the number stored for that pixel in the window identification memory 20, the RGB information is not stored in the display memory. Consequently, only at those addresses of the selected display memory which are within each particular window to which the information is addressed will signals for that window be written. The signal written to the display memory is ultimately transferred from the particular display memory via a multiplexor controlled by the control register 28 to the cathode ray tube 12 shown in FIG. 1.

Because it utilizes only four bits for storage of the window identification number, the system 10 illustrated in FIG. 1 is capable of storing information related only to sixteen windows, the total of unique binary numbers which may be represented in four bits. Obviously such a system cannot be utilized to provide more than sixteen windows at one time without modification. Moreover, it is even more obvious that the provision of a significantly larger number of available windows would render computer systems much more useful in many situations.

The copending patent application referred to above also discloses an arrangement for incorporating three dimensional output displays on the system output device. The system incorporates apparatus for storing information indicative of the depth of each pixel to be provided as output for a particular display on the cathode ray tube. The particular system adds a Z buffer memory which stores Z or depth information values and a Z buffer comparator circuit which compares Z buffer values stored in the Z buffer memory to new Z values for each particular pixel. The Z buffer comparator looks at the old Z value at that pixel position in the Z buffer memory and compares it to the new Z value. If the Z buffer comparison shows that the new Z number is less than or equal to that which is stored in memory, then the new pixel is in a position at the same plane or in front of the pixel previously written; and the write enable logic is activated to write the information regarding that pixel to the appropriate display memory and the Z buffer memory.

An arrangement has now been devised for utilizing the Z buffer memory configuration as an extension of the window identification memory to allow an essentially unlimited number of windows to be utilized at one time so that switching between different programs and documents may be greatly enhanced and the time to accomplish the switching greatly reduced.

The normal Z buffer memory is a full screen display memory which, like the display memories and the window memory previously discussed, stores at each position representing each pixel an indication of the particular position that pixel is to take along the Z-axis. In the preferred embodiment of this invention, the Z buffer memory stores twenty-four bits for each pixel. It will be appreciated that this size of memory can store individual numbers which total substantially greater than the sixteen unique numbers which can be stored in the window identification memory. It will also be appreciated that any particular program or document may not be operating in the three-dimensional domain and, consequently, for that operation the Z buffer memory circuitry will be unused.

Figure 2:
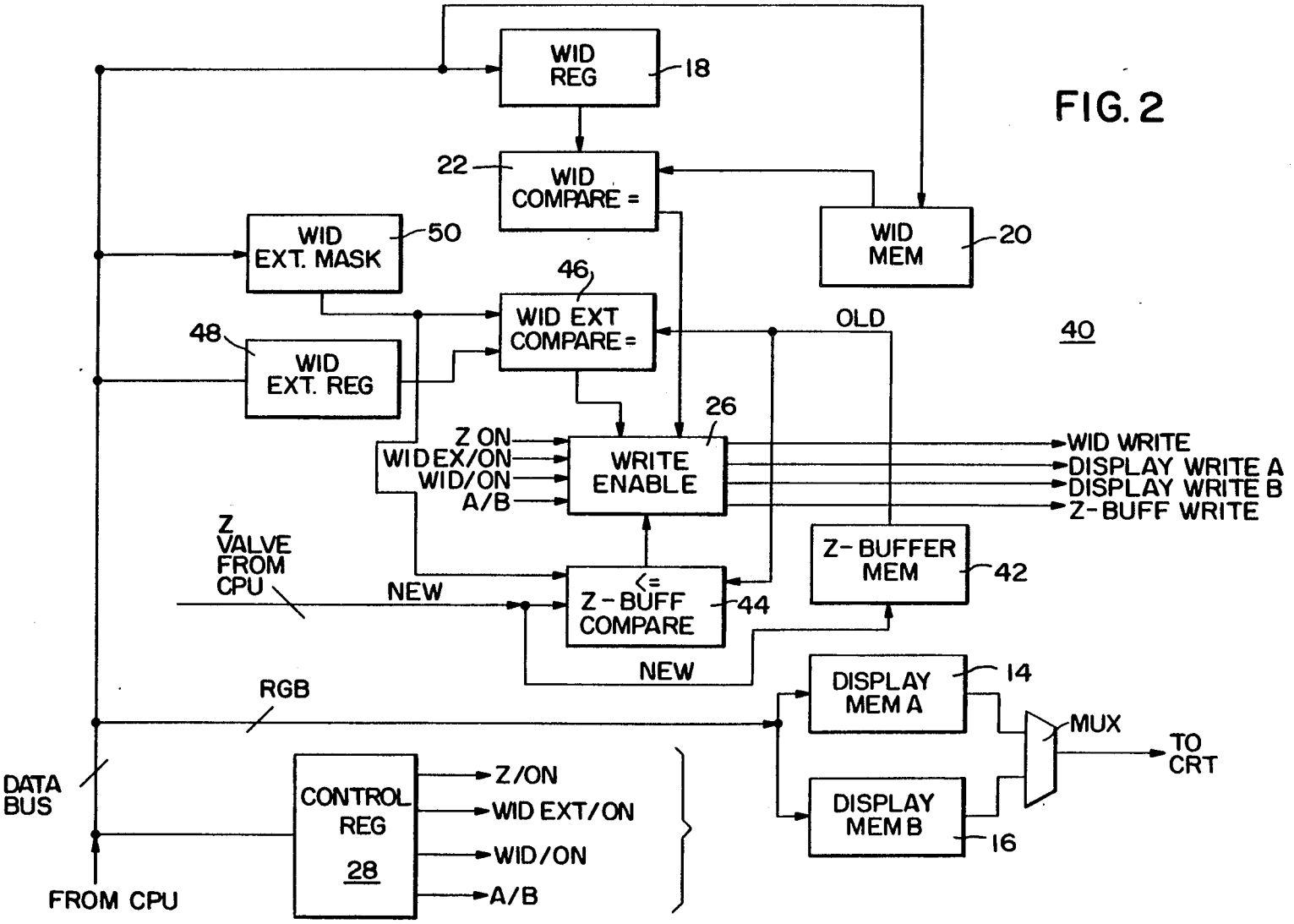
FIG. 2 is a block diagram illustrating an arrangement in accordance with the invention for increasing the number of windows available for display at the output of a computer system.

The arrangement illustrated in FIG. 2 may be utilized to exploit the unused Z buffer memory circuitry for expanding the range of windows which may be used with the system. FIG. 2 illustrates a system 40 which includes the display memories 14 and 16, the WID memory 20, the WID register 18, the WID comparison circuitry 22, the control register 28, and the write enable circuitry 26 which were used in the system 10 referred to above in FIG. 1. The system 20 also includes a Z buffer memory 42 and a Z buffer comparison circuit 44.

In operation the circuitry of system 40 functions as follows. The following discussion presumes that both the window identification 20 and the Z buffer functions have been enabled and either display memory A or B has been selected by the CPU through setting of appropriate bits in the control register 28. The system 40 operates to first determine whether data are within a particular window and then to determine whether the data to be stored for that window lie in front of data already stored in that window. The first step in any operation is to store the window identification values of the windows to be utilized in the window identification memory. This is accomplished by writing to the window identification memory 20 values from the CPU which define the area of each of the window to be utilized.

When it is desired to write a particular pixel to display memory after the windows to be utilized have been defined, the CPU provides the pixel address and color values along with the Z (depth) value. In the window identification comparator circuitry 22, the window number of that data is compared with the window identification number stored in the window identification memory 20 and if they are equal (that is, the information at that pixel is in that window), then an enable signal is transferred to the write enable logic 26.

Presuming that the window comparison has provided an enable signal, it is necessary to make a Z buffer comparison in order to determine whether the present pixel is in front of any pixel already stored. The Z buffer comparison circuitry 44 compares the Z value furnished by the CPU with the Z value previously stored in the Z buffer memory 42 for that pixel. If the Z value furnished by the CPU is equal to or less than that stored in the Z buffer memory 42, then the new signal is in the same plane or in front of the data representing the pixel presently stored, and a signal is provided to cause the write enable logic 26 to write the Z value to the Z buffer memory 42, and the color RGB value to the selected display memory 14 or 16.

In situations in which the Z buffer memory 42 is not used because the information in a particular program is not three dimensional, the Z buffer memory 42 may be utilized to extend the number of windows which may be utilized in the system. This is accomplished by the CPU writing an appropriate value to the control register 28 which indicates that a window number extension is desired. This causes the control register 28 to enable the Z buffer memory 42 for use as a memory for extending the number of available windows. In such a case, the unused memory available in the Z buffer memory 42 is utilized to store window numbers instead. Since the preferred Z buffer memory 42 includes 24 bits of storage at each pixel, substantially larger numbers of windows may be stored.

In order to allow the Z buffer memory 42 to function as a window memory, a window identification extension comparator 46 and a window identification extension register 48 are added to the system 20. These function in a manner similar to the WID register 18 and the WID comparator 22 to compare the window number stored in the Z buffer memory with the extended window number of the incoming value to determine whether the incoming value is in the window to be written. If the incoming and the stored window number are equal, then the value is written to the display memory. If the values do not compare, then the pixel is not in that window and is not written to the display memory. This arrangement allows very large window numbers to be stored and a consequently large number of windows to be available without increasing the size of the window memory 20.

In a preferred embodiment of the arrangement, whenever it is desired to increase the number of windows beyond the normal number which may be stored in the window identification memory 20, the CPU writes an appropriate value into the control register 28 indicating that windows are to be provided beyond the number which the window identification memory 20 is capable of handling. Thereafter, window identification values are represented by the contents of the WID memory 20 and the Z buffer memory 42, and the WID extension register 48. Each window identification value includes twenty-eight bits of information and is used for defining the regions occupied by the extended windows in both the window identification memory 20 and the Z buffer memory 42. Each such value includes four bits of information for storage in the window identification memory 20 and twenty-four bits of information for storage in the Z buffer memory 42. The portion of the value stored in the region defined for that window in the window identification memory 20 defines the region as a zero numbered window while the twenty-four bit portion of the signal stored in the Z buffer indicates in the same region the actual window number. In this manner, the areas with a four bit WID value of 0 are mapped by the system as those designated for the extended window numbers.

Thereafter, when it is desired to write to a window carrying an extended number, the information includes with it twenty-eight bits for defining the window number. In order to determine whether the information is to be written to the display memory, the twenty-eight bit extended window identification number for the pixel (with the four MSB's and zeroes is sent to the WID extension register. The window number in the WID extension register 48 is compared by the WID extension comparator 46 with the number stored in the WID memory 20 and the Z buffer memory 42 for the particular pixel. If the WID memory 20 indicates that a zero is stored for that pixel and the Z buffer number is equal to the remainder of the extended window number in the WID extension register 48, then the information is written to selected display memory. In this manner the Z buffer memory 42 is utilized to extend the number of windows which may be used with the system to an extremely large number.

FIG. 3 illustrates the areas mapped by storage of window numbers in the window identification memory 20 where such a window extension system is utilized. Those areas indicated with zeroes are areas for which extended window numbers are stored in the Z buffer memory 42. FIG. 4 illustrates the areas mapped for the extended windows in the Z buffer memory 42. It should be noted that windows having window numbers 634, 653, and 712 fall in precisely the areas defined for zero windows in the window identification memory.

An extension of the system 40 utilizes a window extension mask 50. This circuitry receives information from the CPU indicating the amount of the Z buffer memory 42 which is to be used for the windows extension memory so that the remaining portion of the Z buffer memory 42 may be used for depth information. The window extension mask 50 is a register which controls the comparator 46 by determining which bits of the twenty-eight available should be used in the WID extension comparator 46. The complement of this mask, or the remaining bits of the total twenty-eight, defines the bits to use for the Z buffer comparator 44. For example, it may be desirable to have some number of windows greater than sixteen but less than the total which can be stored in twenty-four bits. The window extension mask 50 may be utilized to select eight, twelve, sixteen, or twenty bits, for example, of the Z buffer memory 42 for use as extended window memory. For example, since eight bits of memory will store window numbers sufficient for two hundred and fifty-six windows, the window extension mask 50 may be utilized to select eight bits from each pixel of the Z buffer memory 42 for window extension numbers leaving the remaining sixteen bits for the storage of depth information.

FIG. 6 illustrates various options which might be utilized using the window extension mask 50 in the system of FIG. 2. In the first option, no window number extension is used. In the second, eight bits are used for the window number extension and sixteen remain for the depth indication storage. In the third example, sixteen bits are used for the window number extension while eight bits remain for depth indications. In the last example, all of the bits are used to store depth information.

FIG. 5 is a truth table illustrating the signals which may be present in the system 40 shown in FIG. 2 and the responses of the system 40 to those signals. The first column indicates the signal provided by the CPU to the control register. In the first row, this signal is a zero indicating no window extension is desired; in this case, if the numbers in the window identification memory 20 and the window comparator 22 are not equal, then regardless of the result of the window extension comparison and the Z buffer comparison, nothing will be written to the selected display memory and the Z buffer memory 42. In the next two rows of the table where the zero signal indicates no window number extension but the WID comparator 22 indicates that the window indicated by the incoming pixel is equal to the window number stored at the position, the Z buffer memory 42 and the display memory 20 are written in accordance with the results determined by the Z buffer comparator 44.

In the next three rows of the table of FIG. 5, the control register 28 receives a signal indicating that the window number is to be extended. In such a situation, the results provided by the window identification comparator 22 have no effect on the information to be written. If the window extension comparison shows unequal window numbers, then nothing is written to the Z buffer memory 42 and the display memory 20. If the window extension comparison shows that the window number of the incoming signal and that stored in the WID memory 20 and the Z buffer memory 42 are equal, then the result of the Z buffer comparison determines what is written. If the Z buffer comparison shows the Z buffer memory to hold the window extension number of the incoming signal, then the information is written to the display memory. If the numbers are different, the information signal is not written to the display memory.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A computer system comprising:

a display memory for storing information to be present in selected window positions on an output display;

a window identification memory for storing a first portion of window identification numbers regarding window positions on an output display;

a window identification register for storing a first portion of a window identification number indicative of the window in which a particular piece of incoming data is to appear;

a window identification comparator for determining the first portion of the number stored in the window identification register is equal to the first portion of the window identification number stored at a particular pixel in the window identification memory;

a Z buffer memory for storing information indicative of the depth of information to appear on an output display;

a Z buffer register for storing information indicative of the depth of each piece of incoming data;

a Z buffer comparator for determining whether the information in the Z buffer register is at a depth equal to or less than the depth of the information stored in the Z buffer memory;

a window extension register for storing a second portion of a window identification number indicative of the window in which a particular piece of incoming data is to appear;

a control register for causing the storage of the second portion of window identification numbers regarding window positions on an output display in the Z buffer memory;

a window extension comparator for determining if the second portion of the number stored in the window extension register is equal to the second portion of the window identification number stored at a particular pixel stored in the Z buffer memory; and write enable circuitry responsive to the window identification comparator, the Z buffer comparator, and the window extension comparator for causing information to be written to the window identification memory, the Z buffer memory, and the display memory.

2. A computer system comprising:

a display memory for storing information to be presented on an output display, a full screen bitmapped window identification memory for storing information regarding window position on an output display, the window identification memory being capable of storing a first number of bits of information regarding each pixel of the output display;

a first means for storing a first number of bits of information regarding the window in which a particular piece of incoming data is to appear;

a Z buffer memory normally utilized for storing information indicative of the depth of information to appear on an output display, the Z buffer memory being a full screen bitmapped memory capable of storing a second number of bits of information regarding each pixel of the output display;

a window extension register for storing a second number of bits of information regarding the window in which a particular piece of incoming data is to appear;

means for selectively storing the first number of bits of information regarding window position of the output display in the window identification memory and the second number of bits of information regarding window position on the output display in the Z buffer memory; and means for comparing the first number of bits of information stored in the window identification register with the first number of bits of information stored in the window identification memory and the second number of bits of information stored in the window extension register with the second number of bits of information stored in the Z buffer memory;

whereby the amount of information regarding windows is increased by increasing the total number of bits utilized to generate the window information.

3. A computer system as claimed in claim 2 further comprising means for enabling selected numbers of bits at each position of the Z buffer memory to store information regarding window position on the output display.

4. A computer system as claimed in claim 3 in which the means for enabling selected numbers of bits at each position of the Z buffer memory comprises a window extension mask.

5. A computer system as claimed in claim 2 in which the means for selectively storing the second number of bits of information regarding window position on the output display in the Z buffer memory comprises:

a Z buffer register normally used for storing information indicative of the depth of each piece of incoming information;

a Z buffer comparator normally used for determining whether the information in the Z buffer register is at a depth equal to or less than the depth of the information stored in the Z buffer memory;

a control register for causing the storage of the second number of bits of information regarding window position in the Z buffer memory; and write enable circuitry responsive to the Z buffer comparator and the means for comparing, said write enable circuitry causing information to be written to the window identification memory, the Z buffer memory, and the display memory.

6. A computer system as claimed in claim 5 further comprising means for enabling selected numbers of bits at each position of the Z buffer memory to store information regarding window position on the output display.

7. A computer system as claimed in claim 6 in which the means for enabling selected numbers of bits at each position of the Z buffer memory comprises a window extension mask.

8. A computer system comprising:

a display memory for storing information to be presented on an output display;

a full screen bitmapped window identification memory for storing information regarding window position on an output display, the window identification memory being capable of storing a first number of bits of information regarding each pixel of the output display;

a second full screen bitmapped memory normally utilized for storing information indicative of other than window position on an output display, the second memory being a full screen bitmapped memory capable of storing a second number of bits of information greater than the first number regarding each pixel of the output display;

means for selectively storing the first number of bits of information regarding window position of the output display in the window identification memory and the second number of bits of information in the second memory; and means for selectively comparing a first number of bits of the incoming information with the information stored in the window identification memory and a second number of bits of the incoming information with the information stored in the second memory to determine whether the incoming information should appear in a particular window of the output display.

9. A computer system as claimed in claim 8 further comprising means for enabling selected numbers of bits of each position of the second memory to store information regarding window position on the output display.

10. A computer system as claimed in claim 9 in which the means for enabling selected numbers of bits of each position of the second memory comprises a window extension mask.

11. A computer system comprising: a first full screen bitmapped memory for storing information to be presented at an output display; a second full screen bitmapped memory for storing information regarding window position on an output display, the second memory having a limited number of bits to represent each pixel of the output display; a first register for storing input signals indicative of the window in which incoming data is to appear; a first comparator for determining if an input signal stored in the first register is equal to the window position information stored in the second memory regarding a particular pixel of the output display; a third full screen bitmapped memory for normally storing information other than window position information for controlling the appearance of the output display, the third memory having a substantially larger number of storage positions to represent each pixel of the output display; a second register for storing input signals representing information other than window position information; a second comparator for comparing the information in the second register to the information in the third memory regarding a particular pixel of the output display; a third register for storing a portion of a window number greater than a largest window number that is capable of storage in the first register; a control register for causing the storage of a portion of window identification numbers in the third memory; a window extension comparator for comparing numbers stored in the third register with numbers stored in the third memory; and write enable circuitry responsive to the first comparator, the second comparator, and the window extension comparator for causing information to be written to the first memory, the second memory, and the display memory.

12. A computer system as claimed in claim 11 further comprising means for enabling selected numbers of bits of each position of the third memory to store information regarding window position on the output display.

13. A computer system as claimed in claim 12 in which the means for enabling selected numbers of bits of each position of the third memory comprises a window extension mask.

14. A computer system comprising: a first full screen bitmapped memory for storing information to be presented at an output display; a second full screen bitmapped memory for storing a first part of information regarding window position on the output display, the second memory having a first number of bits to represent each pixel of the output display; means for comparing each incoming signal with the information stored in the second memory to determine whether to present such information in a particular window of the output display; a third full screen bitmapped memory for normally storing information to appear on an output display other than window position information, the third memory having a substantially larger number of storage positions than the second memory to represent each pixel of the output display; means for causing a second part of information regarding window position on the output display to be stored in the third memory; means for comparing each incoming signal with the information stored in the second and third memories to determine whether to present such information in a particular window of the output display; and means responsive to the comparison of incoming information and information in the second and third memories for causing information in the display memory to be written to the output display.

15. A computer system as claimed in claim 14 in which the means for comparing incoming signals with the information stored in the third memory comprises: a register for storing input signals representing information other than window position information; a comparator for comparing the information in the register to the information at individual pixel positions of the third memory; a second register for storing a portion of a window number greater than a largest window number that is capable of storage in the first register; a control register for causing the storage of a portion of window identification numbers in the second memory; a window extension comparator for comparing numbers stored in the third register with numbers stored in the third memory; and write enable circuitry responsive to the first comparator, the second comparator, and the window extension comparator for causing information to be written to the first memory, the second memory, and the display memory.

16. A computer system as claimed in claim 14 further comprising means for enabling selected numbers of bits of each position of the third memory to store information regarding window position on the output display.

17. A computer system as claimed in claim 16 in which the means for enabling selected numbers of bits of each position of the third memory comprises a window extension mask.

* * * * *

UNITED STATES PATENT AND TRADEMARK OFFICE

CERTIFICATE OF CORRECTION

PATENT NO. : 5,101,365

DATED : March 31, 1992

INVENTOR(S) : Westberg et al.

It is certified that error appears in the above-identified patent and that said Letters Patent is hereby corrected as shown below:

In column 3 at line 34, please delete " for " and insert -- four --.

In column 5 at line 41, please delete " window " and insert -- windows --.

Signed and Sealed this

First Day of July, 1997

Bruce Lehman

*Attest:*

BRUCE LEHMAN

*Attesting Officer*

*Commissioner of Patents and Trademarks*